US008739703B1

(12) United States Patent
Calvert

(10) Patent No.: US 8,739,703 B1
(45) Date of Patent: Jun. 3, 2014

(54) SHOTGUN SHELL WITH STRUCTURE FOR SHOT MODIFICATION

(71) Applicant: SS Associates, Trustee for SS CRT Trust, Manassas, VA (US)

(72) Inventor: S. Mill Calvert, Manassas, VA (US)

(73) Assignee: SS Associates, Trustee for SS CRT Trust, Manassas, VA (US)

( * ) Notice: Subject to any disclaimer, the term of this patent is extended or adjusted under 35 U.S.C. 154(b) by 0 days.

(21) Appl. No.: 14/067,207

(22) Filed: Oct. 30, 2013

(51) Int. Cl.
*F42B 7/00* (2006.01)

(52) U.S. Cl.
USPC ..... 102/449; 102/462

(58) Field of Classification Search
USPC ..... 102/449, 452, 456, 462, 455, 459, 512
See application file for complete search history.

(56) References Cited

U.S. PATENT DOCUMENTS

| | | | | | |
|---|---|---|---|---|---|
| 306,511 | A | | 10/1884 | Neschdanowsky | |
| 380,689 | A | * | 4/1888 | Peters | 102/462 |
| 2,144,232 | A | * | 1/1939 | Spengler | 102/462 |
| 2,772,634 | A | * | 12/1956 | Oberfell | 102/459 |
| 2,929,647 | A | | 1/1960 | Dear et al. | |
| 3,596,600 | A | * | 8/1971 | Himmelsbach, Jr. | 102/462 |
| 3,724,378 | A | * | 4/1973 | Knight et al. | 102/456 |
| 4,290,365 | A | * | 9/1981 | Dreyer | 102/449 |
| 5,138,950 | A | * | 8/1992 | Gardner et al. | 102/462 |
| 5,644,100 | A | | 7/1997 | Puckett et al. | |
| 5,652,407 | A | * | 7/1997 | Carbone | 102/438 |
| 7,926,424 | B1 | * | 4/2011 | Quintana et al. | 102/458 |
| 8,418,620 | B2 | | 4/2013 | Frank | |

OTHER PUBLICATIONS

Sage Control Ordinance Inc., Model BP45, 40MM Baricade Penetrating Projectile, specifications, published online at http: // www.sageinternationalltd.com/SCOI/specs/SCOI_SpecSheet_BP45.pdf, downloaded Oct. 10, 2013.

* cited by examiner

*Primary Examiner* — Gabriel Klein
(74) *Attorney, Agent, or Firm* — Louis Ventre, Jr.

(57) ABSTRACT

A shotgun cartridge system includes a shotgun shell and a detachable cap. The cap fits within the casing atop the open end so as to close the casing and prevent the projectiles from falling out. An edge recess on the cap enables finger-nail removal of the cap. An injection port enables injection of a coating substance onto the projectiles. The inside wall of the casing may have a projection to snap connect the cap in the casing. The cap then has a mating projection recessed into the cap-wall and structured to snap in place below the projection on the casing when the cap-wall is slid into the casing. Alternatively, the projection is placed so as to form a thread around the inside wall and the cap's mating projection engages the thread when the cap-wall is slid, rotated and tightened against the thread.

7 Claims, 4 Drawing Sheets

SHOTGUN SHELL WITH STRUCTURE FOR SHOT MODIFICATION

TECHNICAL FIELD

In the field of ammunition and explosives, a shotgun cartridge is constructed so as to permit modifying or changing the projectiles that may be fired.

BACKGROUND ART

A shotgun shell, shotshell, or simply a shell is a self-contained cartridge loaded with shot or loaded with a slug. The shot is typically lead shot, but may be other materials including rubber for non-lethal projectiles.

Shotgun shells were first made of solid brass, then transitioned to paper and starting in the 1960s, shotgun shell casings again transitioned to plastic to replace paper casings. Paper and solid brass shells, while rarely used, are still made.

Today, shotgun shells are typically made having a proximal end, head or base covered in a thin brass covering. Shotgun shells having a more powerful propellant charge will often use "high brass" shells, with the brass extended up further along the sides of the plastic casing, while light loads will use "low brass" shells.

In modern shotgun shells, the distal end, or the launching end, of a shotgun shell is typically sealed by either roll crimping or star crimping the plastic casing. In roll crimping, the end wall of plastic casing is rolled down atop a closure wad. Star crimping involves inward crimping or bending the end walls of plastic casing forming a star-shaped seal at the launching end of the shotgun cartridge. Typically, a closure wad is not used in star crimping.

SUMMARY OF INVENTION

A shotgun cartridge system includes a shotgun shell and a cap. The shotgun shell includes a head, a casing, a primer, a powder charge, a wad, projectiles, and an open end. The cap fits within the casing atop the open end so as to close the casing and prevent the projectiles from falling out. The cap is detachable from the shotgun shell. An injection port enables injection of a coating substance onto the projectiles. The inside wall of the casing may have a projection to snap connect the cap in the casing. The cap then has a mating projection recessed into the cap-wall and structured to snap in place below the projection on the casing when the cap-wall is slid into the casing. Alternatively, the projection is placed so as to form a thread around the inside wall and the cap's mating projection engages the thread when the cap-wall is slid, rotated and tightened against the thread. The system may includes second projectiles coated with an agent, the second projectiles fitting with the casing after removal of the projectiles. The agent may be a tranquilizer, a sleep-inducing drug, or other substance desired to be delivered to the target. The projectiles may be within a removable container for ease of removal and replacement.

Technical Problem

Shotgun shells have no means for field changing the projectiles to accommodate a shifting hunting targets or evolving mission parameters experienced during by a hunter, a special weapons and tactile team police officer, or a military special forces soldier.

Changing circumstances can be anticipated for many difficult hunting, police and military operations. Since there are now so many choices of shotgun shells for a hunter, police officer or soldier to pick from, it is not practical for that person to carry all the different types of shells that may be needed. And when circumstances change, that person can be situationally restricted by not being able to modify the shells carried with him or her.

An example of the problem involves a special forces soldier on a mission who only has poison and tranquilizer shells with him, but because of changing circumstances now needs a marking or tracing shot. There is presently no way to modify the shells by changing their payload.

A second example of the problem involves a special weapons police officer under fire from a suspect holed up in a building and needed for questioning. The officer has buck shot in his shotgun but there is presently no way to modify the shells with a less lethal shot coated with a tranquilizer.

Solution to Problem

The solution is shotgun shell with structure for shot modification. With the shotgun shell disclosed herein, the top of a shotgun shell is easily removed and the payload or projectiles changed in a matter of seconds. As circumstances and needs change, so can the shotgun shells change.

The shotgun shell with structure for shot modification works by having a plastic top cap that snaps into the shell opening and is preferably snapped in place using projections or plastic tabs. The top may also have a small finger-nail recess or indentation on the side of it to make it easier to pry the top up and remove it. The top can just be pushed back down onto the shell to lock it in place. The top may also have a small hole in the center whereby chemical agents and substances can easily be injected or squirted inside to coat the pellets.

Advantageous Effects of Invention

A hunter or a soldier can now carry with him a small or contained pouch that has many different types of shot for many different purposes. As circumstances change he can now modify his shells instantly to meet the current situation.

The invention of the shotgun shell with structure for shot modification will now give soldiers and hunters the ability to always make sure that they have the correct shell to meet the correct need. No longer will the soldier or hunter have to carry the heavy-weight bulky load of many different types of shells with him, because he can just take a small number of shells and instantly change their payload as needed.

The shotgun shell with structure for shot modification now makes the shotgun shell a very useful, modifiable tool and this will greatly help our soldiers and law enforcement personnel to win the War on Terror and protect citizens.

The shotgun shell with structure for shot modification now enables real-time modification of the function of a shotgun. There are many different types of shells that determine what the shotgun can be used for. There are all of the typical shells that have different size shot for different objectives. There is, for example, very small shot for birds, larger shot for small animals, larger shot for upland game, larger shot for bigger animals, and larger and larger sizes of buckshot for large game like deer, elk and moose.

With the invention of shotgun shell with structure for shot modification there is very large selection of special shot shells for specific purposes.

BRIEF DESCRIPTION OF DRAWINGS

The drawings illustrate preferred embodiments of the shotgun shell with structure for shot modification according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
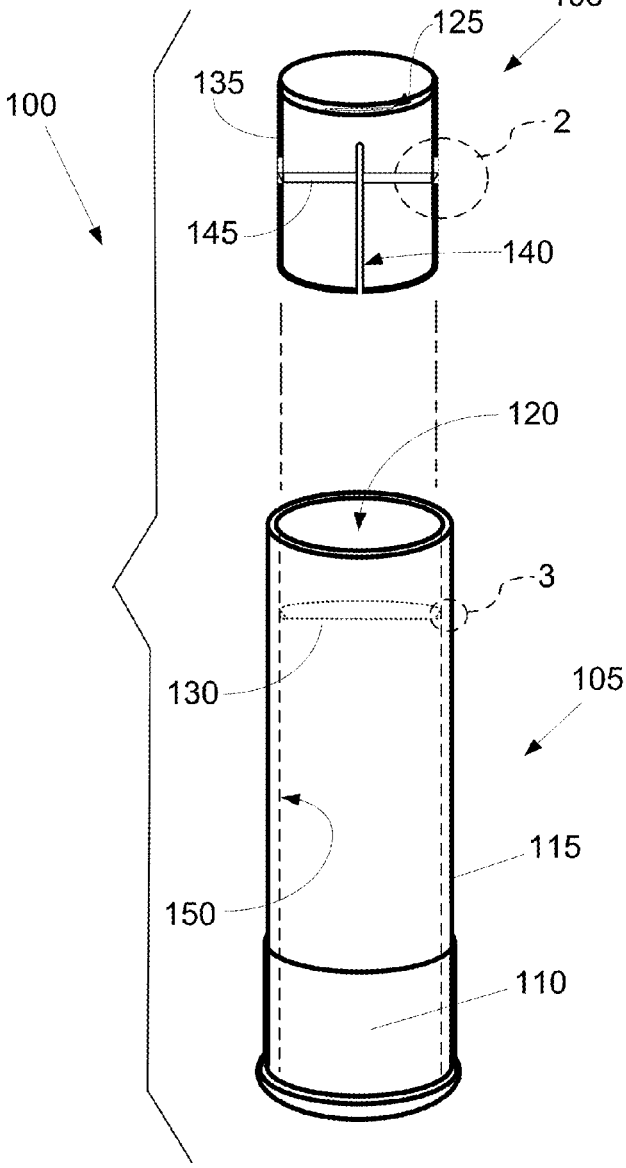
FIG. 1 is an exploded elevation view of the shotgun cartridge system showing a shotgun shell and cap.

FIG. 1 is an exploded elevation view of the shotgun cartridge system (100). The shotgun cartridge system (100) includes a shotgun shell (105) and a cap (106). The shotgun cartridge system (100) is unique in providing a shotgun shell (105) in which the means to seal in the components of the shell is a cap (106) that can be removed, primarily so that the shot can be modified or changed in the field to accommodate the particular conditions relating to a target.

The shotgun shell (105) includes a head (110), a casing (115), a primer (505), a powder charge (510), a wad (515), projectiles (520), and an open end (120). These are standard features of a shotgun shell (105), except that in a completed traditional shells the open end (120) of the casing (115) is crimped closed to seal in the contents of the shell. In the present shotgun cartridge system, the shotgun shell (105) is not closed by crimping the end of the shell casing.

The cap (106) fits within the casing (115) atop the open end (120) so as to close the casing (115) and prevent the projectiles (520) from falling out. The projectiles (520) are also known as shot and as pellets. The cap (106) is detachable from the shotgun shell (105). Any alternative design of the cap that removably covers the end of the shotgun shell (105) may be used.

Figure 8:
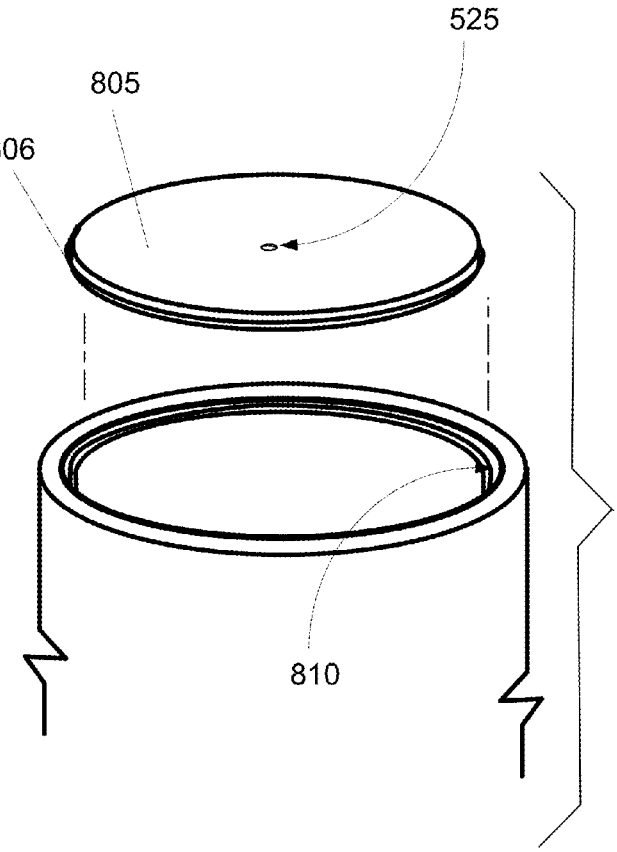
FIG. 8 is a partial exploded view of an alternative embodiment of the shotgun cartridge system using a snap in cap having no downward extending sidewalls.

It is preferable to have the cap (106) snap in place at the end of the shotgun shell (105). Two exemplary snap-in designs are shown: one in FIG. 1 where the cap (106) includes a cap-wall (135) that slides into the casing (115), and another in FIG. 8 showing a rim-projection cap (805) with an edge nub (806) that snaps into a mating groove (810) at the top edge of the casing (115).

Other designs for the cap may be used. A first example, is system having the groove in the cap and bending the top edge of the casing at the open end so that it engages the groove; and having two opposing rails that extend into the casing where a triangular protrusion on the rail snaps under a mating triangular protrusion on the casing (115).

Figure 7:
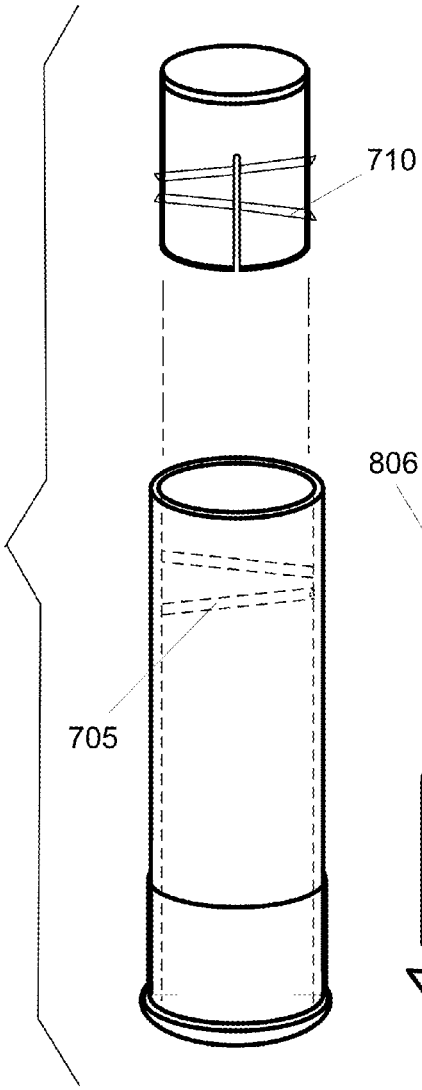
FIG. 7 is an exploded elevation view of an alternative embodiment of the shotgun cartridge system showing a screw in version of the cap.

A second example is the shotgun cartridge system (100) having a projection (130) placed so as to form a thread (705) around the inside wall (150). This is illustrated in FIG. 7. In this embodiment, the cap has the cap-wall (135) with a second mating projection (710) that engages the thread (705) when the cap-wall (135) is slid, rotated and tightened against the thread (705).

Figure 3:
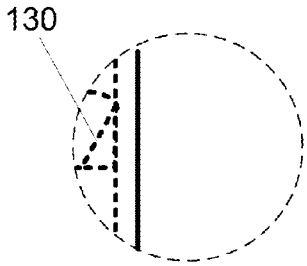
FIG. 3 is another portion of the view in FIG. 1 enlarged for magnification purposes.
Figure 4:
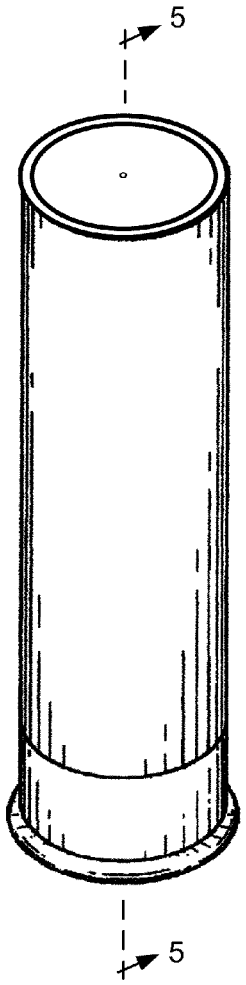
FIG. 4 is a perspective elevation view of the shotgun cartridge system.
Figure 5:
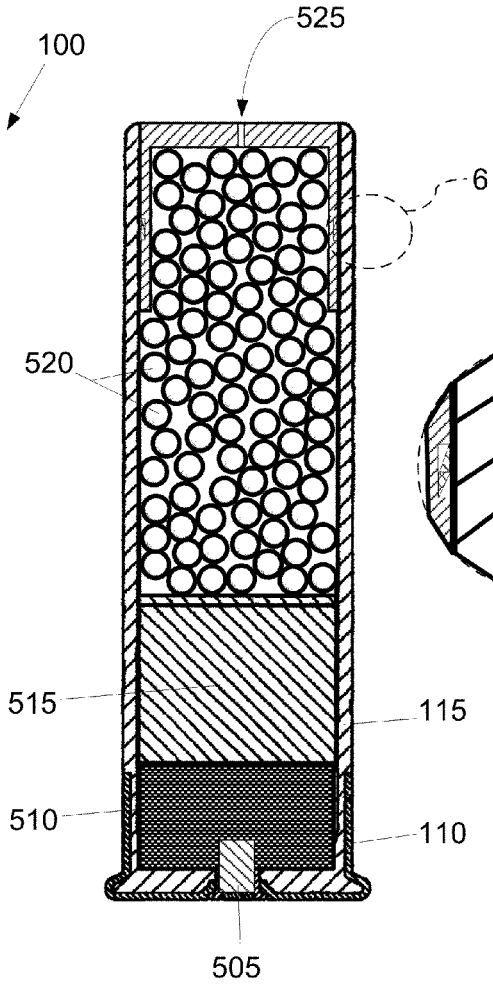
FIG. 5 is a sectional view of the shotgun cartridge system shown in FIG. 4.
Figure 6:
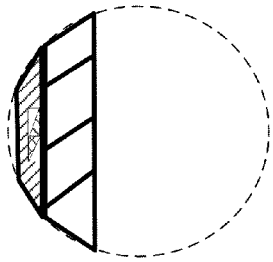
FIG. 6 is a portion of the view in FIG. 5 enlarged for magnification purposes

A preferred design includes the cap (106) having a cap-wall (135) that slides into the casing (115) adjacent to the inside wall (150) of the casing (115). For this preferred design, there is a projection (130) around at least part of the inside wall (150). The projection (130) may extend around the perimeter of the cap-wall (135), may be intermittent around the perimeter, or may comprise as few as two short lengths at opposing points around the perimeter. If the projection is not continuous around the circumference of the inner wall (150), i.e. the perimeter, then the cap (106) may be rotated to free the cap (106) from its secured position so that the cap (106) can be easily removed. The projection (130) is preferably a triangular extension, preferably having a right triangular shape as shown in FIG. 3, where the base of the triangle is closest to the head (110) and the point is closest to the open end (120).

Figure 2:
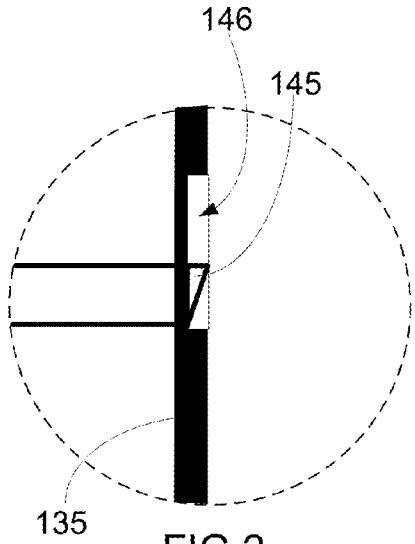
FIG. 2 is a portion of the view in FIG. 1 enlarged for magnification purposes.

Whatever the circumferential extent of the projection (130), the cap (106) will have mating projections that snap in place below the projections on the inside wall (150) of the casing (115) when the cap (106) is placed atop the shotgun shell (105). Preferably, as shown in FIG. 2, the mating projection (145) on the cap-wall (135) has a triangular extension, preferably having a right triangular shape as shown in FIG. 2, where the base of the triangle is closest to the open end (120) and the point is closest to the head (110). That way, when the cap (106) is slid into the shotgun shell (105), the mating projection (145) slides past the projection (130) and snaps in place below the base of the triangle extension on the inside wall (150). Preferably, the mating projection (145) on the cap-wall (135) resides in a recess (146) so that the cap-wall (135) does not separate from the inside wall (150) when being slid into the shotgun shell (105). The cap-wall (135) may include a slot (140), that is one or more slots, to facilitate deformation of the cap-wall (135) when sliding over the projection (130) on the inside wall (150).

Thus, for a preferred embodiment, the cap (106) further comprises a cap-wall (135), the cap-wall (135) comprising a mating projection (145) recessed into the cap-wall (135), said mating projection (145) structured to snap in place below the projection (130) on the inside wall (150) to retain the cap (106) in place when the cap-wall (135) is slid into the casing (115).

For the preferred embodiments, the shotgun cartridge system (100) includes: the casing (115), which includes an inside wall (150) defining a volume holding the primer (505), powder charge (510), wad (515) and projectiles (520); a projection (130) around at least part of the inside wall (150); wherein the cap (106) further comprises a cap-wall (135), the cap-wall (135) comprising a mating projection (145) recessed into the cap-wall (135), said mating projection (145) structured to snap in place below the projection (130) on the inside wall (150) to retain the cap in place when the cap-wall (135) is slid into the casing (115).

The shotgun cartridge system (100) may include an edge recess (125) on the cap (106) to facilitate finger-nail lift up of the cap (106) to enable finger-nail removal of the cap (520).

Figure 9:
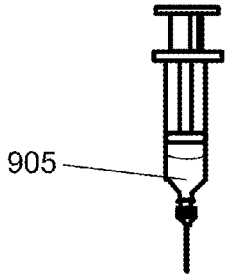
FIG. 9 is an elevation view of a syringe holding a coating substance for injection into the shotgun shell.

The shotgun cartridge system (100) may include an injection port (525) in the cap (106) enabling injection of a coating substance (905) onto the projectiles (520). The cap (106) thus defines the injection port (525). The injection port (525) permits use of a syringe, as shown in FIG. 9, to inject an agent (1110) into and onto the projectiles (520) for delivery to the target. Examples of an agent include: a tranquilizer, a sleep-inducing drug, a nerve chemical, an infectious material, a poison, a nausea inducer, or any other product useful for disabling or marking a target.

Figure 11:
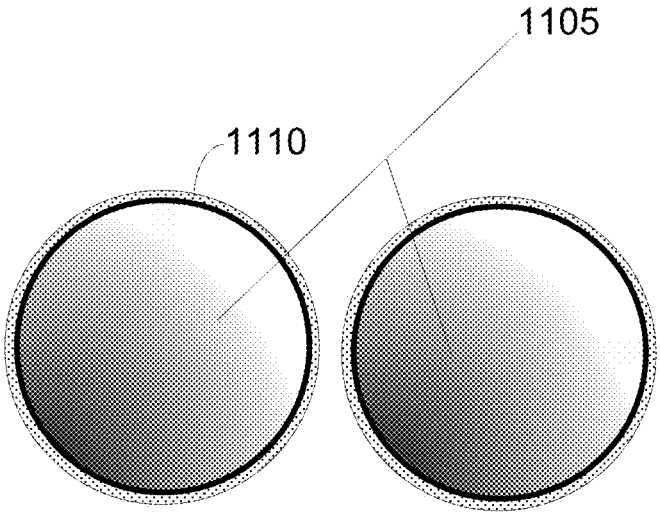
FIG. 11 is an elevation view of second projectiles or pellets that are coated with an agent.

Alternatively, the shotgun cartridge system (100) may include alternative shot, referred to as second projectiles (1105), shown in FIG. 11, which are coated with an agent (1110). The second projectiles (1105) fit within the casing (115) after removal of the projectiles (520). This permits a shooter in the field to make a decision on changing the projectiles in the shotgun shell (105).

Figure 10:
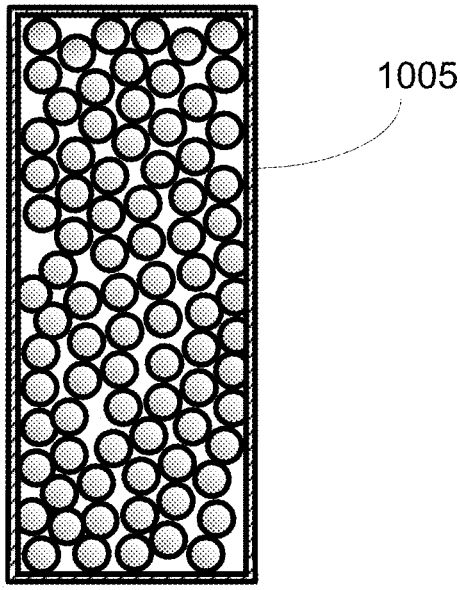
FIG. 10 is a sectional elevation view of a removable container containing shot.

As a matter of convenience and to permit carrying of a variety of pellets, the projectiles (520) may be held in a removable container (1005), as shown in FIG. 10. Thus, the shotgun cartridge system (100) may additionally include a removable container (1005) holding the projectiles (520).

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the firearms industry.

What is claimed is:

1. A shotgun cartridge system comprising a shotgun shell and a cap; the shotgun shell comprising a head, a casing, a primer, a powder charge, a wad, projectiles, and an open end; the cap fitting within the casing atop the open end so as to close the casing and prevent the projectiles from falling out; the cap being detachable from the shotgun shell, the cap further defining an edge recess on an outer circumference to facilitate finger nail lift-up of the cap to enable finger nail detachment of the cap from the casing.

2. The shotgun cartridge system of claim 1, wherein the cap defines an injection port enabling injection of a coating substance onto the projectiles.

3. The shotgun cartridge system of claim 1, wherein the casing comprises an inside wall defining a volume holding the primer, powder charge, wad and projectiles; the shotgun cartridge system further comprising a projection around at least part of the inside wall; wherein the cap further comprises a cap-wall, the cap-wall comprising a mating projection recessed into the cap-wall, said mating projection structured to snap in place below the projection on the inside wall to retain the cap in place when the cap-wall is slid into the casing.

4. The shotgun cartridge system of claim 1, wherein the casing comprises an inside wall defining a volume holding the primer, powder charge, wad and projectiles; the shotgun cartridge system further comprising a projection placed so as to form a thread around the inside wall; wherein the cap further comprises a cap-wall, the cap-wall comprising a mating projection that engages the thread when the cap-wall is slid, rotated and tightened against the thread.

5. The shotgun cartridge system of claim 1, further comprising second projectiles coated with an agent, the second projectiles fitting with the casing after removal of the projectiles.

6. The shotgun cartridge system of claim 5, wherein the agent is selected from the group consisting of a tranquilizer and a sleep-inducing drug.

7. The shotgun cartridge system of claim 1, further comprising a removable container holding the projectiles.

* * * * *